US005467514A

United States Patent [19]

Ku

[11] Patent Number: 5,467,514

[45] Date of Patent: Nov. 21, 1995

[54] LINING STRIP CUTTING MACHINE

[76] Inventor: Fei-Lung Ku, No. 10, Alley 6, Lane 148, Kai Yuan Road, Tainan, Taiwan

[21] Appl. No.: 274,329

[22] Filed: Jul. 13, 1994

[51] Int. Cl.[6] ..... B26D 3/16

[52] U.S. Cl. ..... 29/2.19; 242/525.7

[58] Field of Search ..... 242/525.7, 525.6, 242/525.5, 525, 542.3; 29/2.1–2.25

[56] References Cited

U.S. PATENT DOCUMENTS 4,047,272 9/1977 King et al. ..... 242/525.7

*Primary Examiner*—John M. Jillions

*Attorney, Agent, or Firm*—Morton J. Rosenberg; David I. Klein

[57] ABSTRACT

A lining strip cutting machine is provided. The machine has a flat board for a closed loop of cloth to lie on and to be moved across. A transmission assembly is included to rotate a transferring rod. The machine includes an upper cutting wheel, a lower cutting wheel and a winding roller. A guide rod is provided that is angularly adjustable with respect to the flat board by means of a pair of micro adjusters for moving the closed loop of cloth nearer to the cutting wheels to enable the lining strip to be cut off the cloth which is moving around the flat board, the transferring rod and the guide rod. The machine further includes a cloth stretcher for stretching the closed loop of cloth and thereby correctly cut the lining strip to the right size. A winding roller is provided to contact a strip shaft to pick up the cut lining strip from the cutting wheels and push it onto the strip shaft to be wound thereon.

5 Claims, 11 Drawing Sheets

LINING STRIP CUTTING MACHINE

BACKGROUND OF THE INVENTION

This invention is directed to a lining strip cutting machine. Particularly, this invention is directed to such a machine having a micro adjuster between a guide rod and a flat elongate work board, a cloth stretcher, and a weight temporarily hung at a tail end of a swingable support arm for special cloth for cutting, a metal sleeve releasably fitted around a rubber winding roller, band rings with strong friction force fixed around a transferring rod, and an upper and a lower cutting wheel provided with radial small grooves.

Linings for underwear, sleeves, lapels, etc. are cut by means of a lining strip cutting machine. In conventional machines, material cloth has to be manually moved on a flat work board so that the cloth may be moved nearer to an upper and a lower cutting wheel to cut a lining strip from the cylindrically-shaped closed loop of cloth. Such manual work is hard to perform at a definite speed and worker's hands may easily tire. Moreover, the cylindrically-shaped closed loop of cloth may easily be displaced by blowing air currents, causing the lining strip to be cut with different widths. In addition, when cutting twill or denim cloth having smooth surfaces, but little elasticity, different operational speeds of the related components makes it hard to cut the twill or denim cloth by means of conventional cutting machines.

SUMMARY OF THE INVENTION

The present invention has been devised to offer a lining strip cutting machine, which can automatically move cylindrically-shaped closed loops of cloth to be cut into lining strips in a stretched condition, and can also cut cloth having little elasticity by adding several means.

BRIEF DESCRIPTION OF THE DRAWINGS

The invention will be better understood by reference to the accompanying drawings, wherein.

DESCRIPTION OF THE PREFERRED EMBODIMENTS

Figure 1:
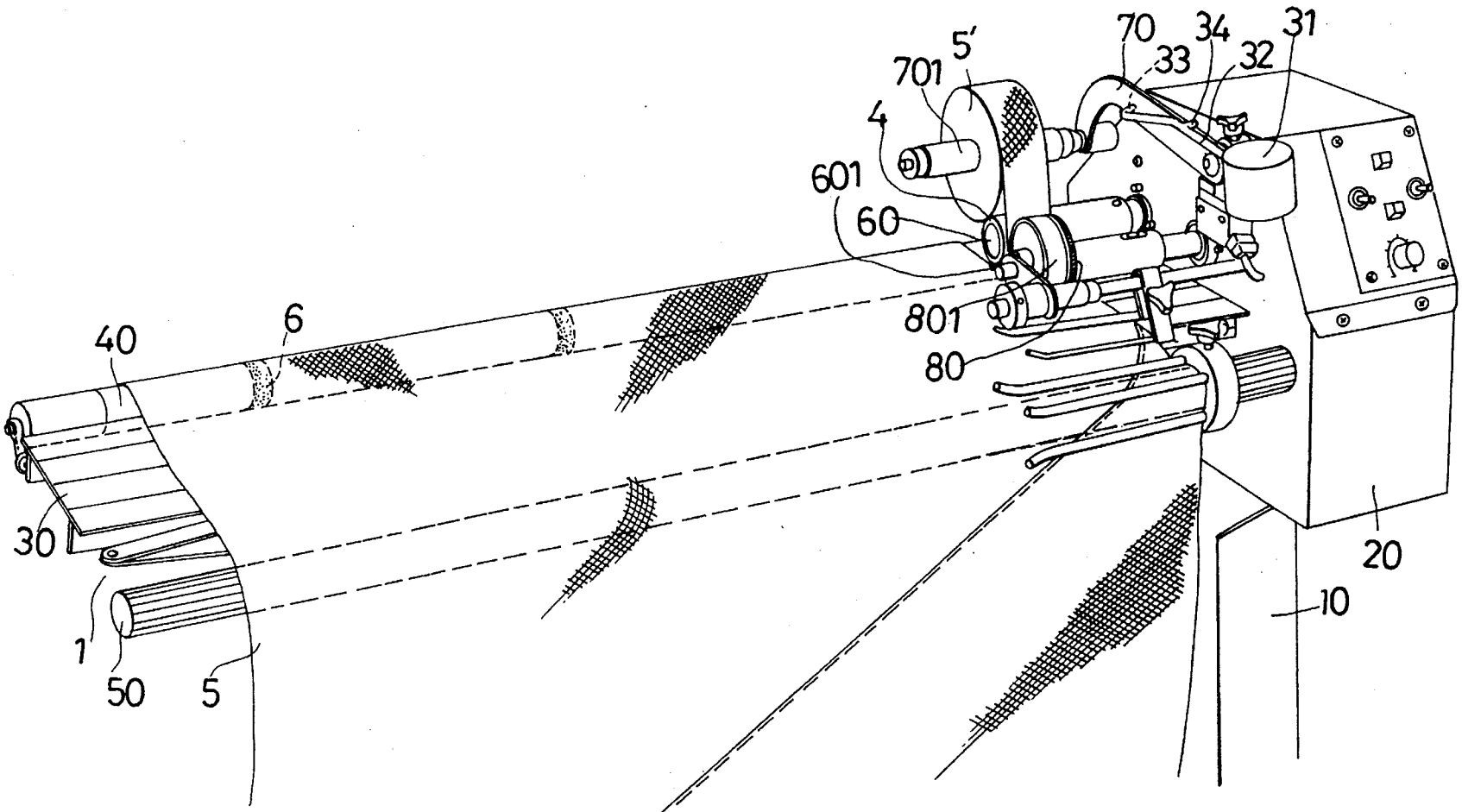
FIG. 1 is a perspective view of a lining strip cutting machine of the present invention.
Figure 2:
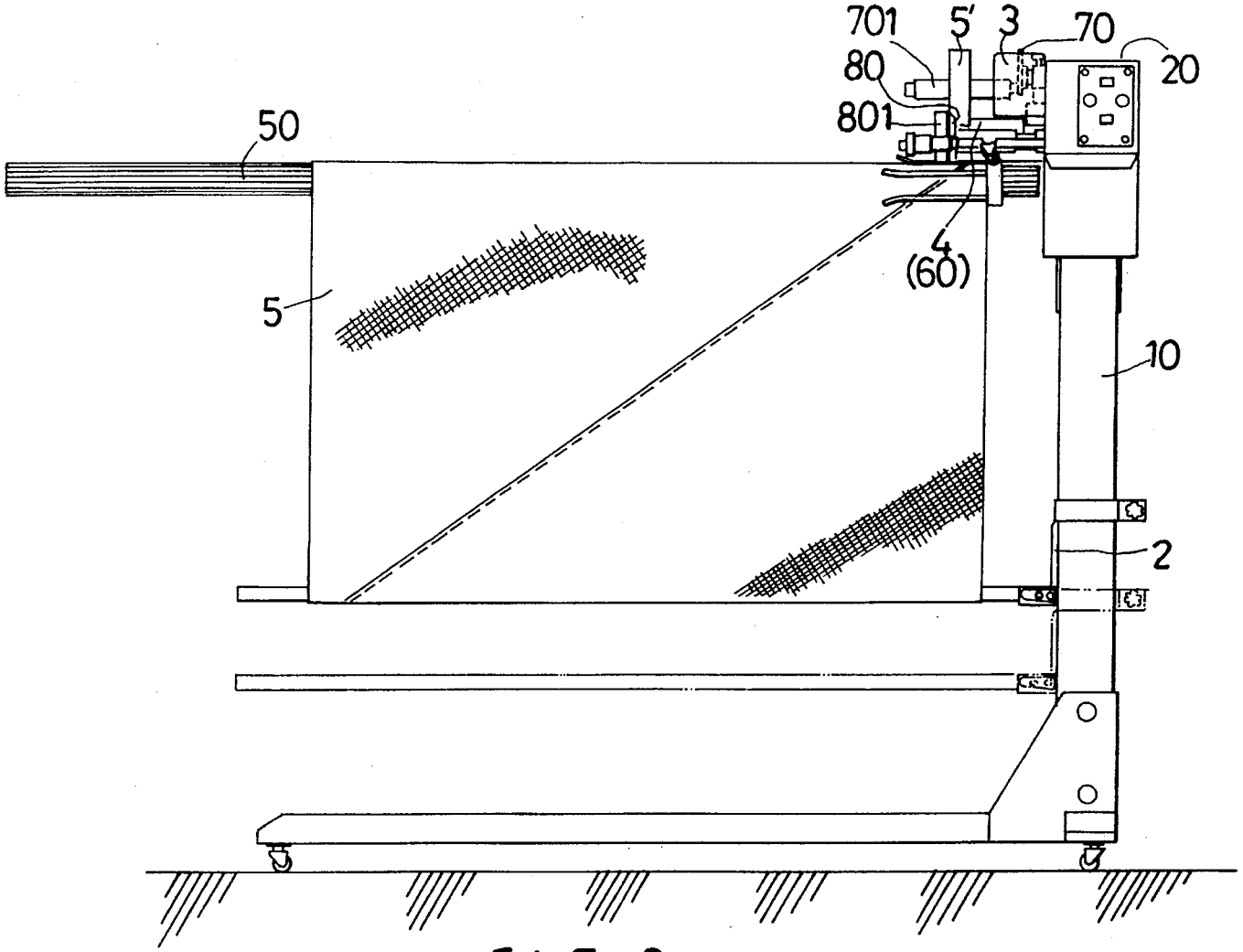
FIG. 2 is a front view of the lining strip cutting machine of the present invention.
Figure 3:
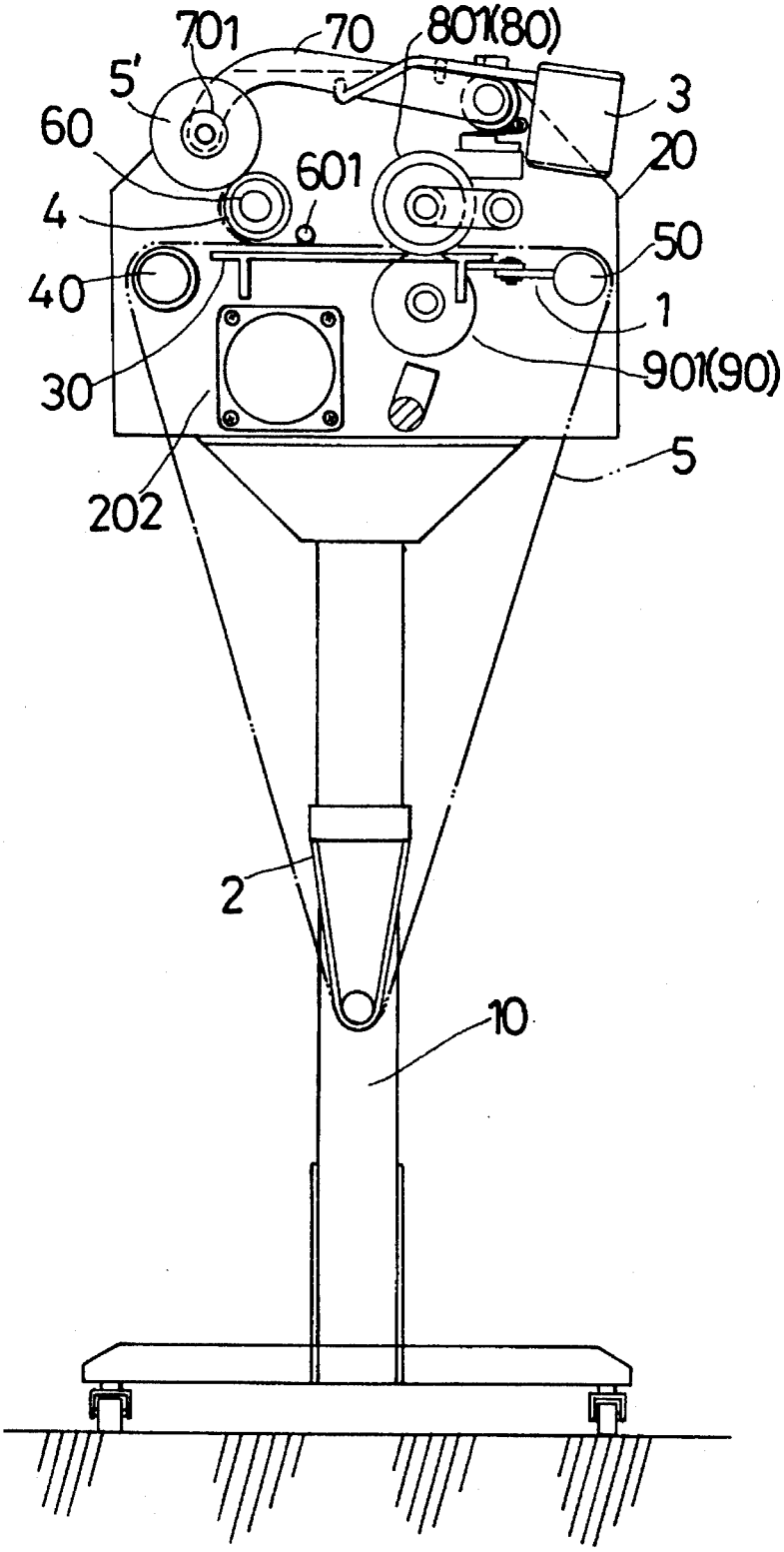
FIG. 3 is a side view of the lining strip cutting machine of the present invention.

The lining strip cutting machine, as shown in FIGS. 1, 2 and 3, includes a machine frame 10, a transmission assembly 20 and an elongate flat work board 30. An elongate transferring rod 40 is provided at one longitudinal side of the board 30 and rotated by the transmission assembly 20. An elongate guide rod 50 is provided along the other longitudinal side of the board 30. A winding roller 60 made of rubber and located a little above the flat board 30 is rotated by the transmission assembly 20. A swingable arm 70 is pivotally connected to the transmission assembly 20 at one end and has an opposing end which is bent in a curved contour. A strip shaft 701 is supported by the bent end of the swingable arm 70 for winding the cut lining strip. An upper cutting wheel 80 and a lower cutting wheel 90 are connected to and rotated by the transmission assembly 20 for cutting a lining strip 5' from a cylindrically-shaped closed loop of cloth 5. An upper pressing wheel 801 and a lower pressing wheel 901 are located respectively beside the upper cutting wheel 80 and the lower cutting wheel 90.

Figure 4:
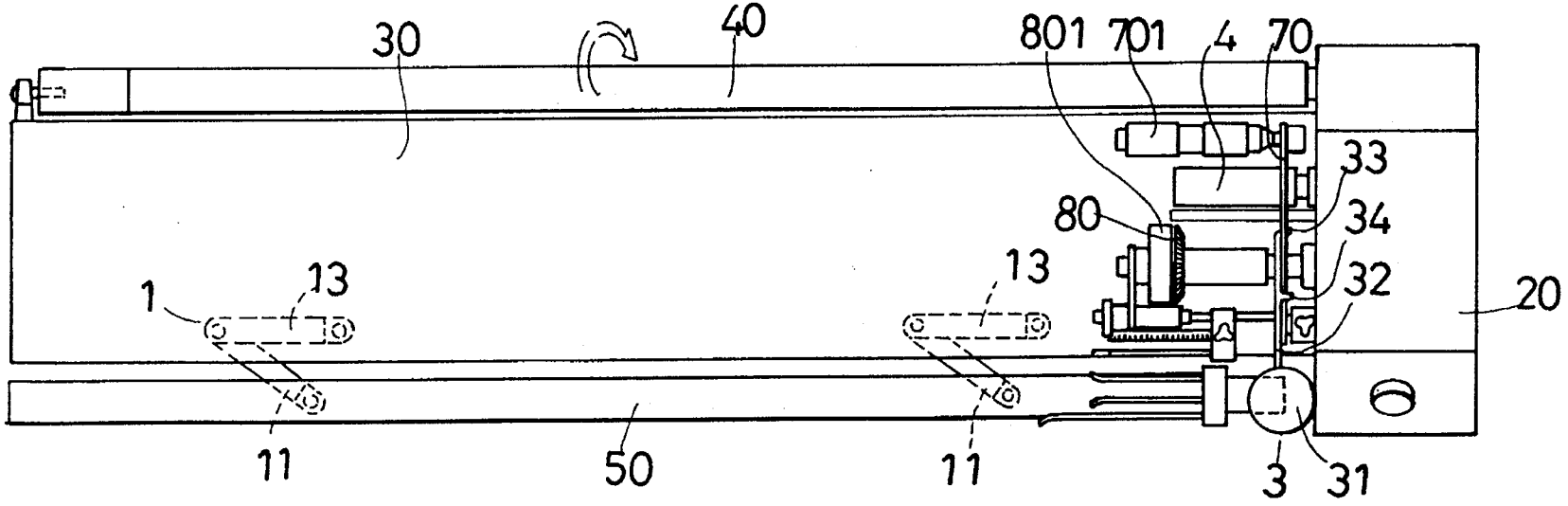
FIG. 4 is a top view of the lining strip cutting machine in the present invention, showing a guide rod in unextended position.
Figure 5:
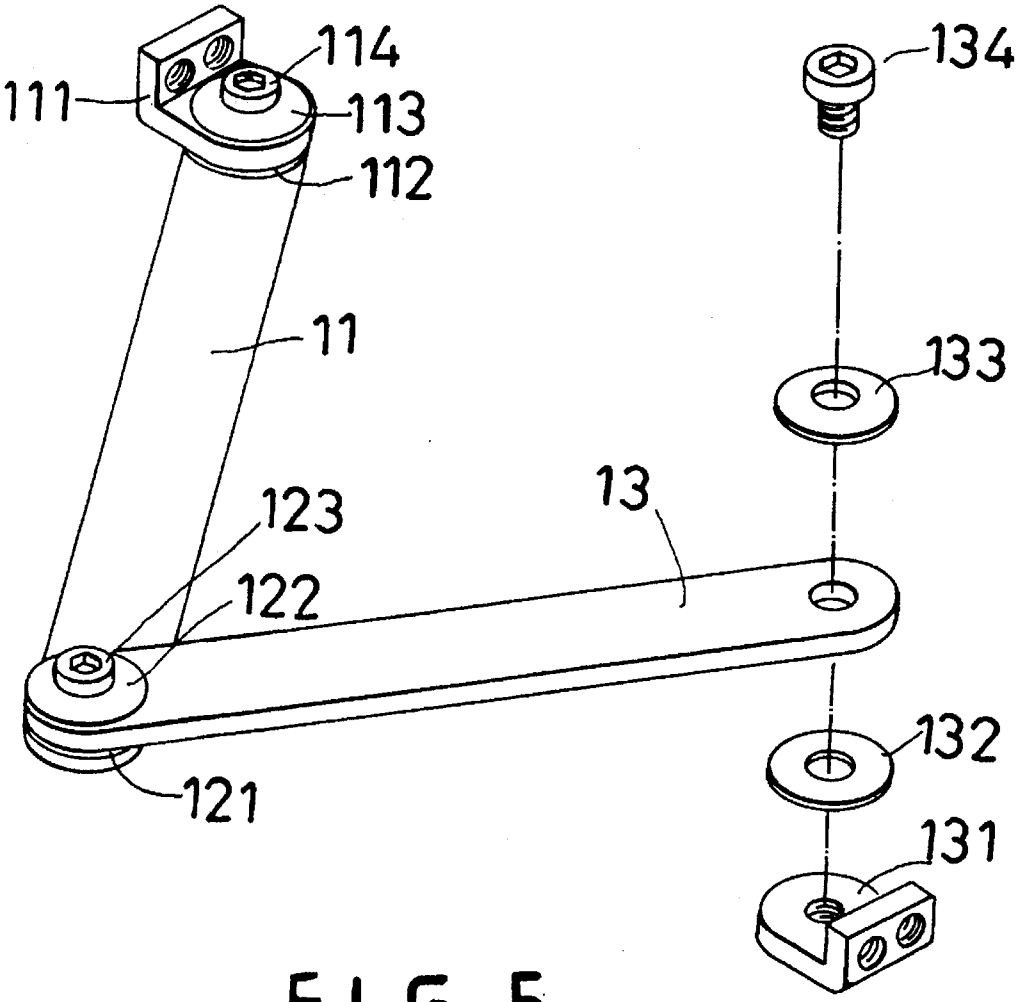
FIG. 5 is a perspective view of a micro adjusting unit in the lining strip cutting machine of the present invention.
Figure 6:
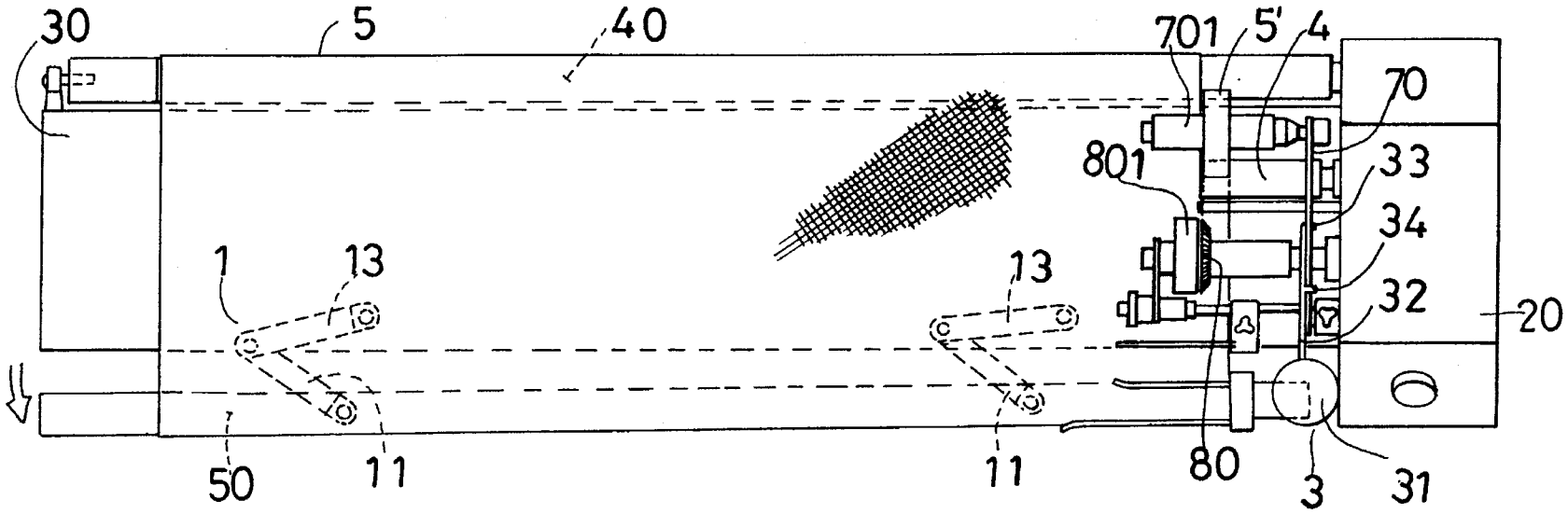
FIG. 6 is a top view of the lining strip cutting machine of the present invention, showing the guide rod in extended position.

The elongate guide rod 50 shown in FIGS. 1, 4 and 5 is disposed in spaced relationship from the outer wall of the transmission assembly 20, and connected indirectly to the inner side of the flat board 30 by means of a pair of micro adjusters 1, such that the guide rod 50 may be adjusted to extend at an angle with respect to the side of the flat board 30. The angle of the guide rod 50 guides the moving closed loop of cloth on the flat board 30 to move angularly nearer to the cutting wheels 80 and 90. That arrangement enables the inner side of the cloth 5 to be cut by the cutting wheels, forming a continuous lining strip, the whole cloth 5 being cut into a continuous strip.

Each of the pair of micro adjusters 1 respectively has a first arm 11 and a second arm 13 having one end of each pivotally connected together with a screw 123, a washer 121 and a curved washer 122. The other end of the first arm 11 is connected with the flat board 30 by means of a connector 111 having a centrally located threaded hole. Such connection with the connector 111 by a washer 112, a curved washer 113 and a screw 114 extending through the arm 11 and the two washers 112 and 113 to threadedly engage the connector 111. The other end of the second arm 13 is connected to the guide rod 50 by means of a connector 131 having a threaded hole formed therein, a lower washer 132, an upper curved washer 133 and a screw 134. The screw 134 engages the threaded hole of the connector 131 through a hole in the end of the second arm 13 and the two washers 133 and 132 disposed on opposing sides of arm 13.

The pair of the micro adjusters 1 are used for minutely adjusting the angle formed between the first and the second arm by loosening and tightening the screw 123. The curved washer 122 has some elasticity for providing a bias force against the head of the screw 123, keeping the tightness of the screw to maintain the adjusted angle between the first and the second arms 11 and 13. The washer 121 allows the adjuster 1 to be adjusted, even where the first and the second arms have a rough contact surface.

When a worker is going to operate this machine to cut a lining strip 5', as shown in FIGS. 1, 2 and 3, a piece of cloth 5 formed in a closed loop is inserted from the outer end of the board 30 such being placed on the board 30. Then the guide rod 50 is extended outward from the board 30 by handling the pairs of the micro adjusters 1 so that the outer end of the guide rod 50 is located a farther distance away from the board 30 than the distance the inner end of the guide rod 50 is located from the board 30. The angle of the guide rod 50 with respect to the board 30 will be set in proportion to the width of lining strip 5' to be cut from the cylinder-shaped cloth 5 by the upper cutting wheel 80 and the lower cutting wheel 90. Therefore, the guide rod 50 has to be angularly extended properly with respect to the board 30 so that the cut lining strip 5' will have the proper width, as ordered by a customer.

The transferring rod 40 is rotated by the transmission assembly 20 to move the closed loop cloth 5 forward across the board 30 to the guide rod 50. The right end portion of the cloth 5 is then cut by the upper cutting wheel 80 and the lower cutting wheel 90. The cut lining strip 5' is picked up by the winding roller 60, which displaces the strip 5' to be wound on the strip shaft 701. Strip shaft 701 contacts and is rotated by the winding roller 60.

Figure 7:
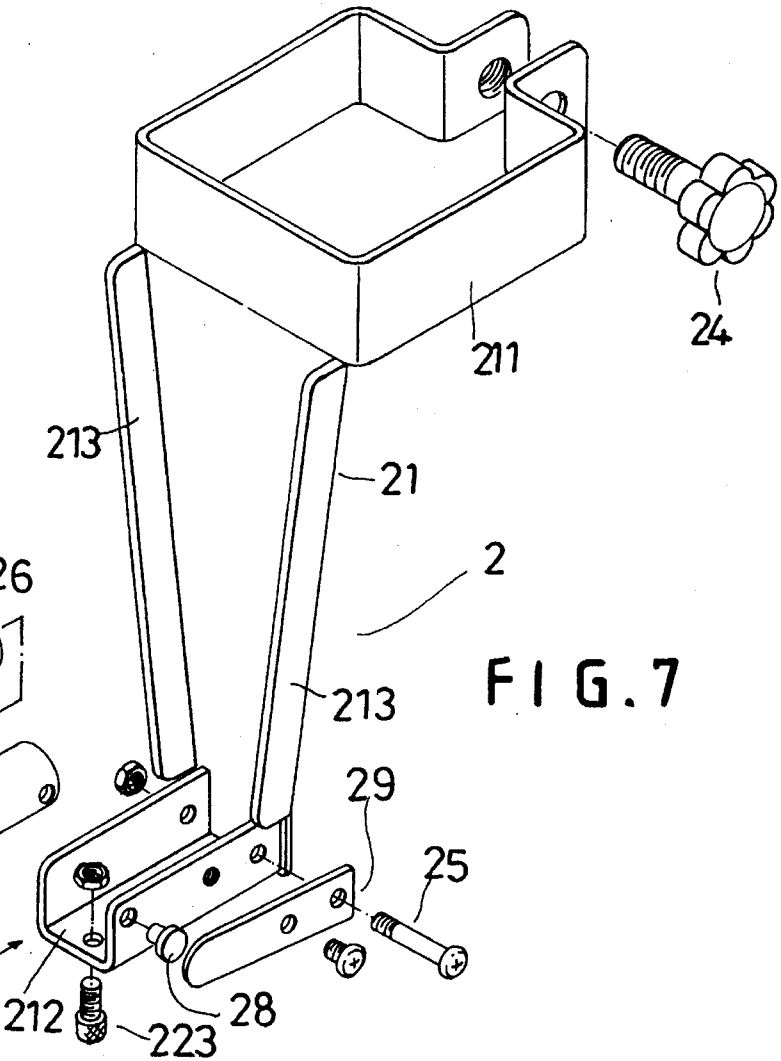
FIG. 7 is an exploded perspective view of a cloth stretcher in the lining strip cutting machine of the present invention.
Figure 8:
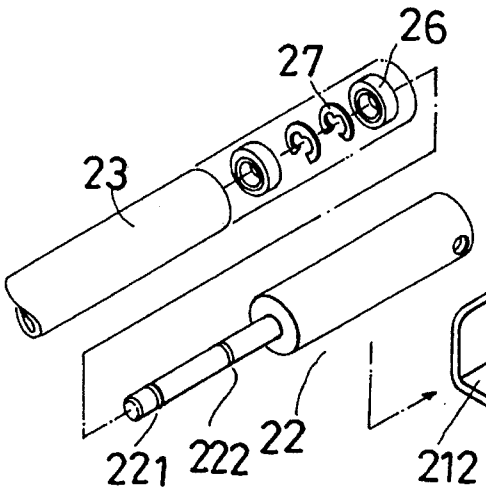
FIG. 8 is a cross-sectional view of the cloth stretcher in the lining strip cutting machine of the present invention.
Figure 8:
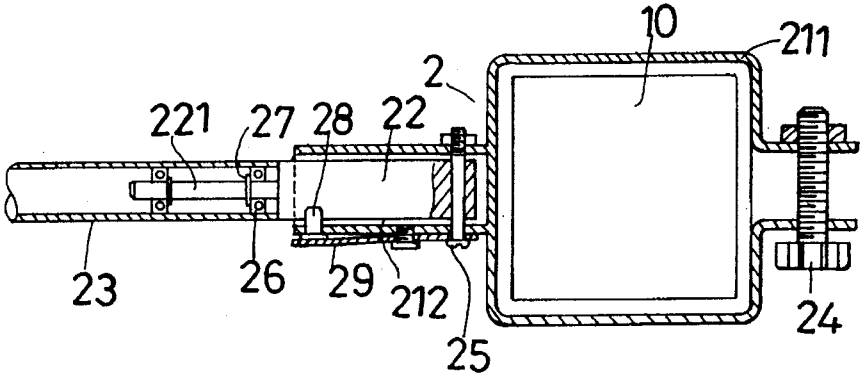

A cloth stretcher 2 is provided, as shown in FIGS. 2 and 3, at a lower portion of a machine frame 10 for stretching the closed loop of cloth 5 laterally below the board 30 to enable the cloth 5 to move smoothly around the board 30, the transferring rod 40, the guide rod and a stretching tube of the cloth stretcher 2. The cloth stretcher 2, as shown in FIGS. 7 and 8, includes a locating body 21 having a clamping portion 211 at the top end thereof. The locating body 21 has two inclined sides 213, 213 disposed under the clamping portion 211. A channel-shaped portion 212 is located under the lower ends of the two inclined sides 213, 213. A connecting tube 22 is disposed in the channel-shaped portion 212, and a stretching tube 23 is rotatably coupled to the connecting tube 22. The clamping portion 211 clamps around the machine frame 10 and is tightened or released by a screw 24 with a large head, to facilitate adjustment of the height of the cloth stretcher 2. The channel-shaped portion 212 has an opening defined by two opposite longitudinal walls for the connecting tube 22 to fit therebetween, with the tube 22 being pivotally connected by means of a bolt and nut 25. The connecting tube 22 has a small diameter shaft 221 extending from a front end thereof. Two lock washers 27 are located between two bearings 26, the lock washers 27 being engaged around the small shaft 221 on two respective annular grooves 222. Then the hollow supporting tube 23 is slid over the bearings 26 and overlays the whole length of the small shaft 221. An urging button 28 is provided to fit in a hole formed in one of the two parallel walls of the channel-shaped portion 212. An elastic plate 29 is provided to extend laterally and is affixed on the parallel wall on which the urging button 28 is provided, elastically pushing the urging button 28 inwardly, to bias the connecting tube 22 stably in place. Moreover, an adjusting screw 223 is provided to screw through the bottom of the channel-shaped portion 212 to adjustably push up the connecting tube 22 to maintain the position of the tube 22 horizontal.

Figures 9, 10:
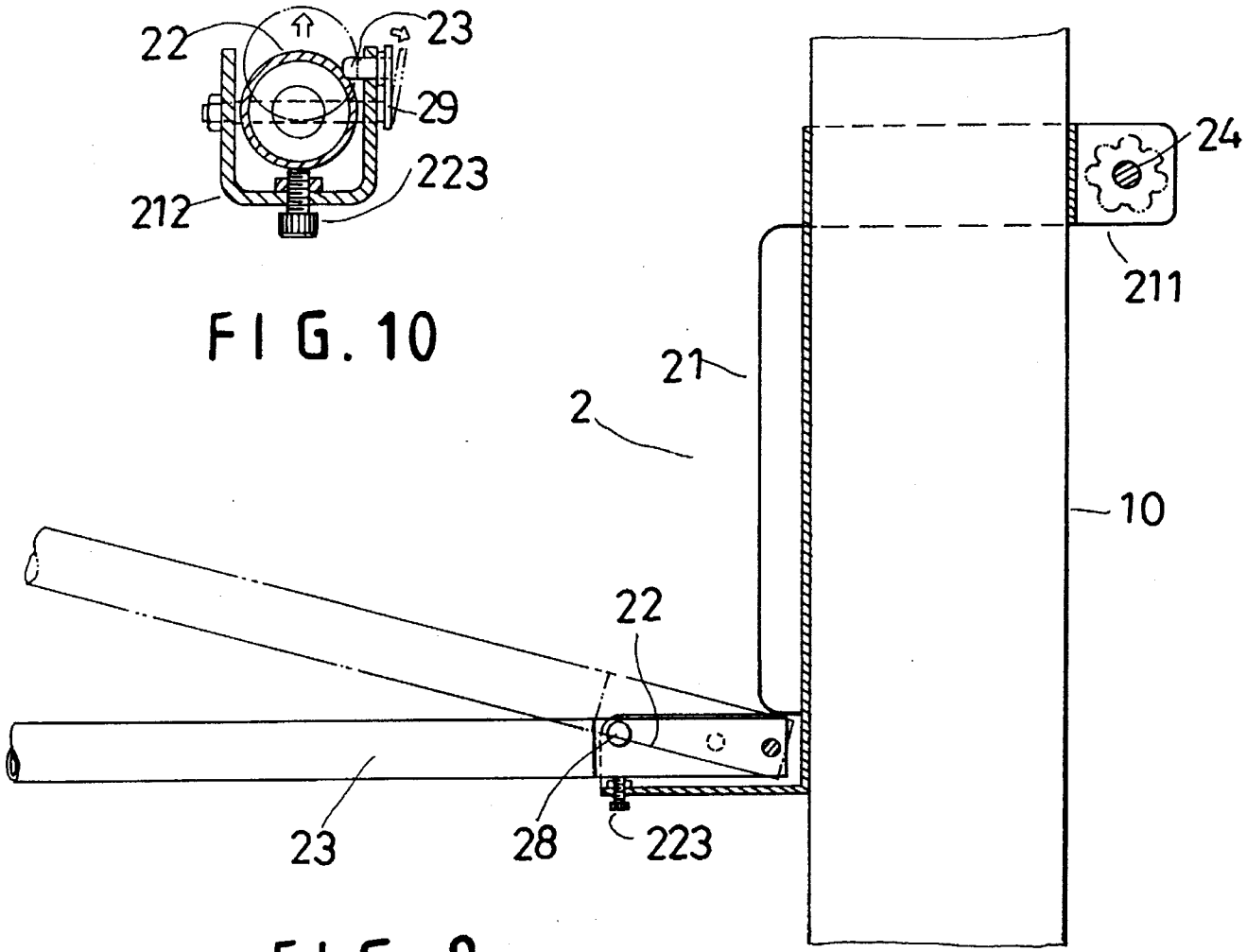
FIG. 9 is a front view of the cloth stretcher in the lining strip cutting machine of the present invention, showing the cloth stretcher being in operation.
FIG. 10 is a cross-sectional view of the cloth stretcher in the lining strip cutting machine of the present invention, showing the cloth stretcher in operation.

As shown in FIGS. 9 and 10, after the cloth stretcher 2 is fixed on the machine frame 10, the supporting tube 23 together with the connecting tube 22 can be lifted to slope upwardly, with the urging button 28 pushed by the connecting tube 22 to move outward and push outward the elastic plate 29 until the supporting tube 23 is sloped up at a certain angle. Then, the urging button 28 is moved back into the opening of the channel-shaped portion 212, under the bias force of elastic plate 29. Now the closed loop of cloth 5 can be inserted from the outer end of the transferring rod 40, the board 30, the guide rod 50 and the stretching tube 23, and placed on the flat board 50 in correct position, as shown in FIGS. 2 and 3. It is necessary that the lower portion of the closed loop of cloth 5 be located under the stretching tube 23. Then, the stretching tube 23 is moved down to a proper position for properly stretching the cloth 5, and kept at that position by adjusting the adjusting screw 223. Alternately, the locating body 21 can be moved up and down relative to the machine frame to cope with different lengths of the cloth 5. By this arrangement the cloth 5 is never caused to move to and fro by an external force or wind, but is kept in place for proper cutting.

Figure 11:
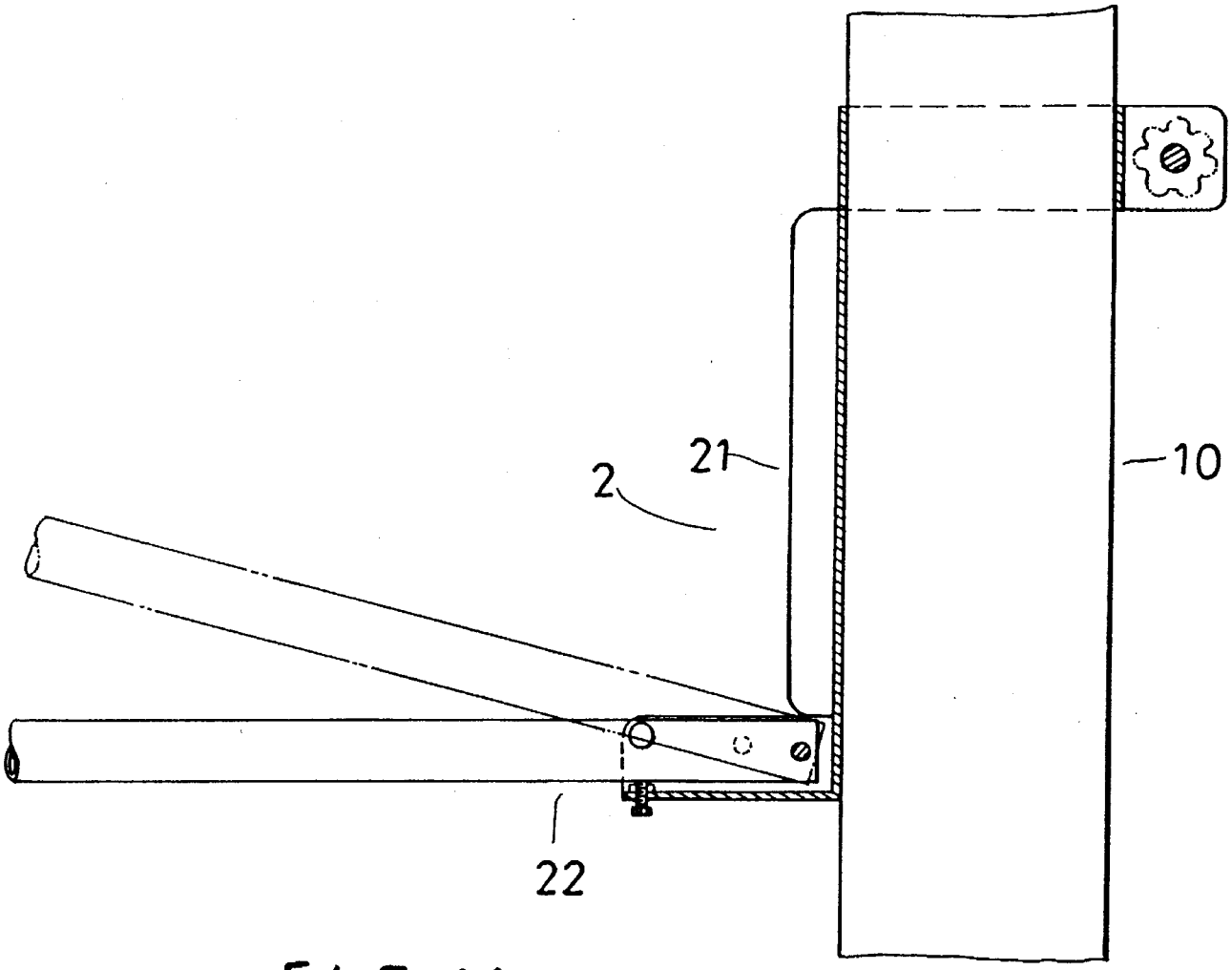
FIG. 11 is a side view of a second embodiment of the cloth stretcher in the lining strip cutting machine of the present invention.

When cloth 5 is a slippery material to be cut by this machine, the rotatable stretching tube 23 is of no use, and an elongate tube 22 without bearings should be used instead of the combined connecting tube 22 and stretching tube 23, as shown in FIG. 11. Then the slippery cloth 5 can slide over the smooth surface of the tube 22, and at the same time stretched by the tube 22.

Figure 13:
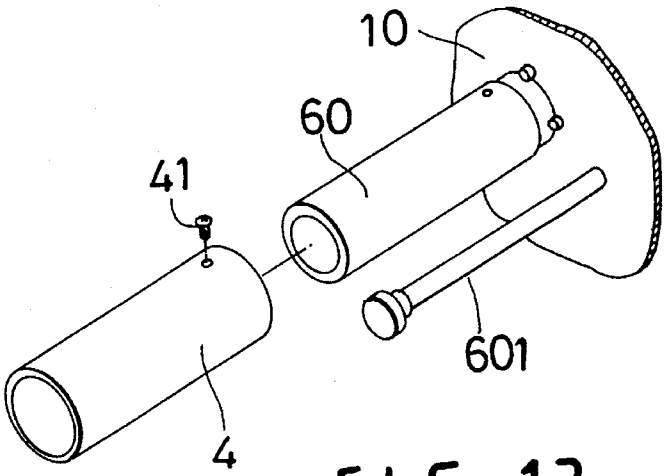
FIG. 13 is a perspective view of a sleeve fitted around a winding roller in the lining strip cutting machine of the present invention for cutting twill or denim cloth.
Figure 12:
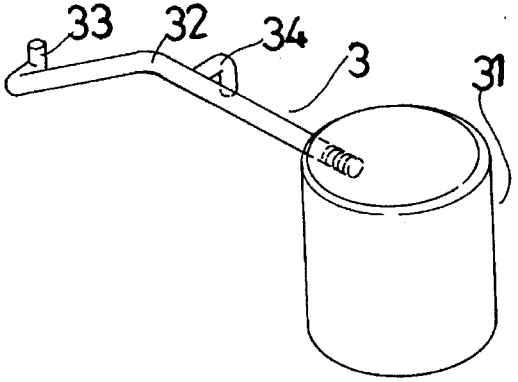
FIG. 12 is a perspective view of a weight unit used in the lining strip cutting machine for cutting twill or denim cloth.

When the cloth 5 is a twill or denim material to be cut by this machine, a weight unit 3, as shown in FIG. 12, is attached to the swingable arm 70. Because twill or denim cloth 5 have no elasticity, it is impossible to absorb difference between the rotating speed of the upper cutting wheel 80 and the lower cutting wheel 90 and the winding roller 60. The weight unit 3 includes a weight 31, and a support arm 32 connected at one end to the weight 31, with a hook 33 formed at the other end and a hook 34 formed at an intermediate portion of the arm 32. The weight unit 3 is hung on an inner end of the swingable arm 70, such that cut lining strip wound on the strip shaft 701 will have a weaker contact force with the winding roller 60. In addition, a metal sleeve 4, shown in FIG. 13, with a smooth surface is provided to fit tightly around the rubber winding roller 60 with screws 41, thereby reducing frictional contact force with the cloth 5. The sleeve 4 slows down the speed of the strip shaft 701 rotated by the roller 60 for balancing the rotating speed difference of the roller 60 and the upper cutting wheel 80 and the lower cutting wheel 90. On the other hand, twill or denim cloth having a smooth surface, and biasing force of the cloth 5 at the cutting wheels 80 and 90 is rather large, such that band rings 6 made of a material having a large frictional force, such as sand paper, are added on the transferring rod 40. The band rings 6 prevent the cloth 5 from biasing too much during cutting by the cutting wheels 80, 90.

Figure 15:
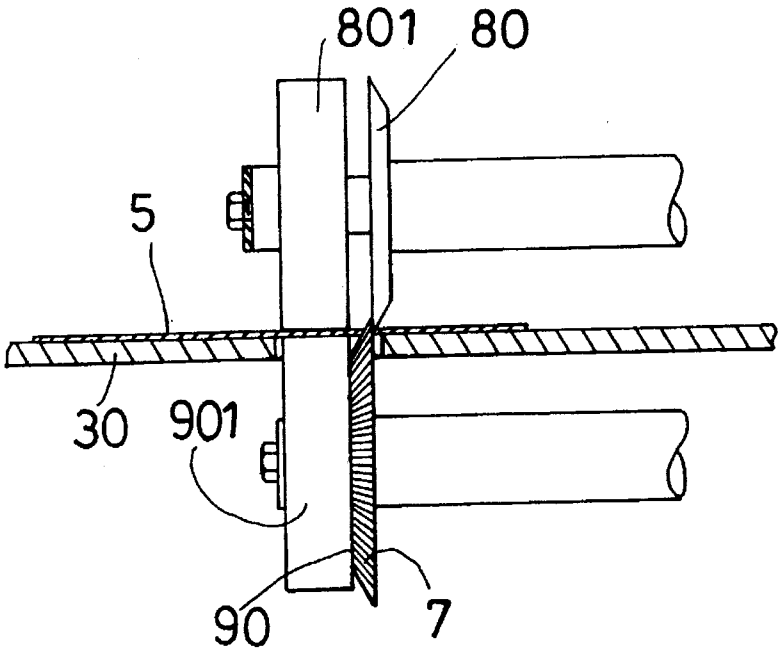
FIG. 15 is another side view of the upper cutting wheel and the lower cutting wheel in the lining strip cutting machine of the present invention when cutting twill or denim cloth; and, FIG. 16 is a perspective view of a second embodiment of the weight unit used in the lining strip cutting machine of the present invention.
Figure 14:
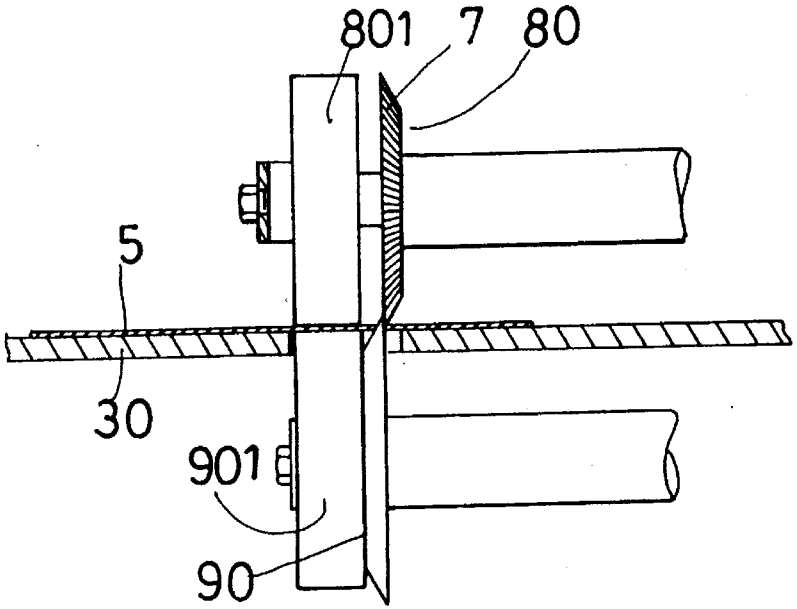
FIG. 14 is a side view of an upper cutting wheel and a lower cutting wheel in the lining strip cutting machine of the present invention.

As shown in FIGS. 14 and 15, the upper cutting wheel 80 and the lower cutting wheel 90 are provided with a plurality of radial shallow grooves 7 forming ridges between each two grooves 7, in order to balance their rotating speed to acquire a balanced cutting operation.

Figure 16:
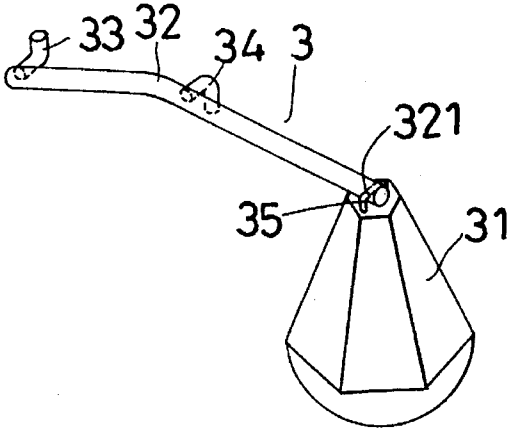

FIG. 16 shows another embodiment of the weight unit 3, which has a support arm 32 having a lateral hole in one end for receiving a U-shaped pin therethrough to affix the arm 32 to the weight 31.

While the preferred embodiments of the invention have been described above, it will be recognized and understood that various modifications may be made therein and the appended claims are intended to cover all such modifications which may fall within the spirit and scope of the invention.

What is claimed is:

1. A lining strip cutting machine comprising:

a machine frame supporting a transmission assembly on a top portion thereof;

said transmission assembly rotating a transferring rod, an upper cutting wheel and a lower cutting wheel and a winding roller, disposed on top of said machine frame;

a flat long board having one end connected with and supported by said machine frame, said flat long board receiving a closed loop of cloth thereon from which a lining strip is to be cut;

said transferring rod being located along one side of said flat long board, said transferring rod having one end connected to and rotated by said transmission assembly to move a closed loop cloth across said flat long board;

an elongate guide rod located along an other side of said flat long board, said guide rod having one end supported by a side wall of said transmission assembly said guide rod being connected with a pair of micro adjusters for angularly positioning said guide rod relative to said flat board, said angularly positioned guide rod forcing said closed loop of cloth to move angularly toward said upper cutting wheel and said lower cutting wheel;

each of said pair of micro adjusters including a first arm and a second arm pivotally connected each to the other with a screw, a washer and a curved washer, said first arm having an outer end connected with said flat board by means of connecter, a screw, a washer and a curved washer, said second arm having an outer end connected with said guide rod by means of a connecter, a screw, and two washers, said pair of micro adjusters enabling each end of said guide rod to be a predetermined distance from said flat board by displacing a respective second arm relative to a respective first arm, and thereby positioning said guide rod at an angle needed to make said closed loop of cloth move angularly nearer to said cutting wheels in accordance with the width of a lining strip to be cut by said cutting wheels;

a winding roller located in abutting relationship with said upper cutting wheel, said winding roller being connected with said transmission assembly to be rotated thereby so as to pick up a lining strip cut from said closed loop of cloth by said cutting wheels, said winding roller passing said lining strip onto a strip shaft to wind said strip thereon;

said strip shaft being located to always be in contact with said winding roller, said strip shaft being movably supported on an inner end by a curvingly bent end of a swingable arm pivotally coupled to an outer wall of said transmission assembly;

said upper cutting wheel and said lower cutting wheel connected to and rotated by said transmission assembly for cutting a lining strip from the closed loop of cloth moving across said flat board, said upper cutting wheel being located over said flat board, said lower cutting wheel being located under said flat board, both said cutting wheels having a plurality of radial grooves forming ridges between each two grooves for balancing speed differences therebetween;

a cloth stretching unit fixed at a lower portion of said machine frame, including:

a locating body having an upper clamp movably clamping around an intermediate portion of said machine frame by means of a screw bolt, said locating body having two inclined sides located under said clamp, and a channel-shaped portion for receiving a connecting tube therein is disposed below said two inclined sides;

said connecting tube fitting in channel-shaped portion of said locating body and being pivotally connected therewith, said connecting tube having a small diameter shaft extending from an outer end thereof, two bearings and two lock washers being disposed on said small diameter shaft for supporting one end portion of a stretching tube slid over said bearings, an urging button disposed within a hole in one parallel wall of said channel-shaped portion of said locating body to press against said connecting tube, an elastic plate with one end fixed on said parallel wall and another end pushing elastically against said urging button for applying a bias force thereto;

said elongate stretching tube being rotatable on said two bearings on said small shaft of said connecting tube, said elongate stretching tube stretching a lower drooping portion of said closed loop of cloth; and, a weight unit provided to be hung at an inner end of said swingable arm to decrease a frictional contact force between said strip shaft and said winding roller for cutting twill or denim cloth.

2. The lining strip cutting machine as claimed in claim 1, wherein the channel-shaped portion of said locating body of said cloth stretcher has an adjusting screw screwing through its bottom to contact and push up said connecting tube for keeping the horizontal position of said stretching tube.

3. The lining strip cutting machine as claimed in claim 1, wherein an elongate tube is used instead of said connecting tube and said stretching tube.

4. The lining strip cutting machine as claimed in claim 1, wherein said weight unit has a support arm with a hook at one end and in an intermediate portion, and a weight threadedly connected with an opposing end of said support arm.

5. The lining strip cutting machine as claimed in claim 1, wherein said weight unit has a weight and a support arm with a hook at one end and in an intermediate portion and with a lateral hole at an opposing end for receiving an inverted U-shaped pin therethrough to firmly affix said support arm with a top of said weight.

* * * * *